US011283175B2

(12) United States Patent
Han et al.

(10) Patent No.: US 11,283,175 B2
(45) Date of Patent: Mar. 22, 2022

(54) ANTENNA APPARATUS

(71) Applicants: SAMSUNG ELECTRO-MECHANICS CO., LTD., Suwon-si (KR); Research & Business Foundation Sungkyunkwan University, Suwon-si (KR)

(72) Inventors: Myeong Woo Han, Suwon-si (KR); Nam Ki Kim, Suwon-si (KR); Young Sik Hur, Suwon-si (KR); Yong Serk Kim, Suwon-si (KR); Keum Cheol Hwang, Suwon-si (KR); Nam Heung Kim, Suwon-si (KR); Jeong Ki Ryoo, Suwon-si (KR)

(73) Assignees: Samsung Electro-Mechanics Co., Ltd., Suwon-si (KR); Research & Business Foundation Sungkyunkwan University, Suwon-si (KR)

( * ) Notice: Subject to any disclaimer, the term of this patent is extended or adjusted under 35 U.S.C. 154(b) by 28 days.

(21) Appl. No.: 16/822,143

(22) Filed: Mar. 18, 2020

(65) Prior Publication Data

US 2021/0151889 A1 May 20, 2021

(30) Foreign Application Priority Data

Nov. 20, 2019 (KR) ..... 10-2019-0149282

(51) Int. Cl.
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
CPC ..... H01Q 1/38; H01Q 1/48; H01Q 9/045; H01Q 15/006; H01Q 15/0026; H01Q 21/065
See application file for complete search history.

(56) References Cited

U.S. PATENT DOCUMENTS 6,597,324 B2 7/2003 Eriksson
9,270,030 B2 * 2/2016 Alexopoulos ..... H01Q 19/10
(Continued)

FOREIGN PATENT DOCUMENTS

JP 2009-44522 A 2/2009
KR 10-2019-0089955 A 7/2019
WO WO 2018/119153 A1 6/2018

*Primary Examiner* — Tung X Le
(74) *Attorney, Agent, or Firm* — NSIP Law

(57) ABSTRACT

An antenna apparatus includes a ground plane; first and second patch antenna patterns disposed above and spaced apart from a first surface of the ground plane and from each other; a second feed via to provide a second feed path of the second patch antenna pattern, and disposed adjacent to an edge of the second patch antenna pattern; a first feed via to provide a first feed path of the first patch antenna pattern, and disposed adjacent to an edge of the first patch antenna pattern that is opposite to the second patch antenna pattern; a first coupling pattern disposed between the first patch antenna pattern and the second patch antenna pattern along the first direction; a ground via; and a second coupling pattern disposed between the second patch antenna pattern and the first coupling pattern along the first direction.

24 Claims, 15 Drawing Sheets

(56) References Cited

U.S. PATENT DOCUMENTS

| | | | | |
|---|---|---|---|---|
| 2008/0048917 | A1* | 2/2008 | Achour | H01Q 9/0407 343/700 MS |
| 2008/0169992 | A1* | 7/2008 | Ortiz | H01Q 21/064 343/767 |
| 2020/0014113 | A1* | 1/2020 | Asaka | H01Q 21/065 |
| 2021/0044028 | A1* | 2/2021 | Lee | H01Q 21/061 |

* cited by examiner

ANTENNA APPARATUS

CROSS-REFERENCE TO RELATED APPLICATION(S)

This application claims the benefit under 35 USC § 119(a) of Korean Patent Application No. 10-2019-0149282 filed on Nov. 20, 2019 in the Korean Intellectual Property Office, the entire disclosure of which is incorporated herein by reference for all purposes.

BACKGROUND

1. Field

The following description relates to an antenna apparatus.

2. Description of Background

Mobile communications data traffic has increased on an annual basis. Various techniques have been developed to support rapidly increasing data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images from a user's viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

A radio frequency (RF) signal of a high frequency band (e.g., 24 GHz, 28 GHz, 36 GHz, 39 GHz, 60 GHz, and the like) may easily be absorbed and lost while being transmitted, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and an RFIC, effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An antenna apparatus which may improve antenna performance (e.g., gain, bandwidth, directivity, etc.), and/or may be easily miniaturized.

In one general aspect, an antenna apparatus includes a ground plane; a first patch antenna pattern disposed above and spaced apart from a first surface of the ground plane; a second patch antenna pattern disposed above and spaced apart from the first surface of the ground plane, and spaced apart from the first patch antenna pattern; a second feed via configured to provide a second feed path of the second patch antenna pattern through a point of the second patch antenna pattern, and disposed adjacent to an edge of the second patch antenna pattern that is adjacent to the first patch antenna pattern along a first direction; a first feed via configured to provide a first feed path of the first patch antenna pattern through a point of the first patch antenna pattern, and disposed adjacent to an edge of the first patch antenna pattern that is opposite to the second patch antenna pattern along the first direction; a first coupling pattern disposed between the first patch antenna pattern and the second patch antenna pattern along the first direction, and spaced apart from the first patch antenna pattern and the second patch antenna pattern along the first direction; a ground via configured to electrically connect the first coupling pattern to the ground plane; and a second coupling pattern disposed between the second patch antenna pattern and the first coupling pattern along the first direction, spaced apart from the second patch antenna pattern and the first coupling pattern along the first direction, and separated from the ground plane.

The first feed via may include a plurality of first feed vias, the first coupling pattern may include a plurality of first coupling patterns, and at least two of the plurality of first coupling patterns may be spaced apart from each other along a second direction.

The ground via may include a plurality of ground vias electrically connected to the plurality of first coupling patterns, respectively.

A length of the second coupling pattern along the second direction may be larger than a length of each of the at least two of the plurality of first coupling patterns along the second direction.

A gap between the at least two of the plurality of first coupling patterns along the second direction may be smaller than a gap between the at least two of the plurality of first coupling patterns and the second coupling pattern along the first direction.

A length of the first patch antenna pattern along a second direction may be larger than a length of the first coupling pattern along the second direction and a length of the second coupling pattern along the second direction.

A width of the second coupling pattern along the first direction may be smaller than a width of the first coupling pattern along the first direction.

A gap between the first coupling pattern and the second coupling pattern along the first direction may be smaller than a gap between the first coupling pattern and the first patch antenna pattern along the first direction.

A gap between the first coupling pattern and the second coupling pattern along the first direction may be smaller than a gap between the second coupling pattern and the second patch antenna pattern along the first direction.

The second patch antenna pattern may be spaced apart from the first surface of the ground plane more than the first patch antenna pattern.

The antenna apparatus may include a first upper patch pattern disposed above and spaced apart from a surface of the first patch antenna pattern opposite the ground plane; and a second upper patch pattern disposed above and spaced apart from a surface of the second patch antenna pattern opposite the ground plane. A spacing between the second patch antenna pattern and the second upper patch pattern may be smaller than a spacing between the first patch antenna pattern and the first upper patch pattern.

The antenna apparatus may include a first upper patch pattern disposed above and spaced apart from a surface of the first patch antenna pattern opposite the ground plane; a second upper patch pattern disposed above and spaced apart from a surface of the second patch antenna pattern opposite the ground plane; and an upper coupling pattern disposed above and spaced apart from a surface of the first coupling pattern opposite the ground plane.

The second coupling pattern may not overlap the upper coupling pattern in a thickness direction of the antenna apparatus.

In another general aspect, an antenna apparatus includes a ground plane; second patch antenna patterns disposed above and spaced apart from a first surface of the ground plane along a thickness direction of the antenna apparatus, and spaced apart from each other along a first direction normal to the thickness direction; first patch antenna patterns disposed above and spaced apart from the first surface of the ground plane along the thickness direction, spaced apart from each other along the first direction, and disposed between the second patch antenna patterns along the first direction; second feed vias configured to provide second feed paths of the second patch antenna patterns through respective second points of the second patch antenna patterns disposed adjacent to edges of the second patch antenna patterns that are adjacent to the first patch antenna patterns along the first direction; first feed vias configured to provide first feed paths of the first patch antenna patterns through respective first points of the first patch antenna patterns disposed adjacent to edges of the first patch antenna patterns opposite the adjacent second patch antenna patterns along the first direction; and first coupling patterns disposed between the first patch antenna patterns and the second patch antenna patterns along the first direction, and spaced apart from the first patch antenna patterns and the second patch antenna patterns along the first direction. A space disposed between the first patch antenna patterns and spaced apart from the first surface of the ground plane a same distance as the first patch antenna patterns includes a non-conductive material or air.

The second patch antenna patterns may be spaced apart from the first surface of the ground plane more than the first patch antenna patterns.

The antenna apparatus may include first upper patch patterns disposed above and spaced apart from surfaces of the first patch antenna patterns opposite the ground plane; and second upper patch patterns disposed above and spaced apart from surfaces of the second patch antenna patterns opposite the ground plane. A spacing between the second patch antenna patterns and the second upper patch patterns may be smaller than a spacing between the first patch antenna patterns and the first upper patch patterns.

The antenna apparatus may include first upper patch patterns disposed above and spaced apart from surfaces of the first patch antenna patterns opposite the ground plane; second upper patch patterns disposed above and spaced apart from surfaces of the second patch antenna patterns opposite the ground plane; and upper coupling patterns disposed above and spaced apart from surfaces of the first coupling patterns opposite the ground plane.

The antenna apparatus may include a third upper patch pattern disposed between the first upper patch patterns along the first direction.

The antenna apparatus may include ground vias electrically connecting the first coupling patterns to the ground plane.

In another general aspect, an antenna apparatus includes a ground plane; a first patch antenna pattern spaced apart from a first surface of the ground plane by a first distance along a first direction; a second patch antenna pattern spaced apart from the first surface of the ground plane by a second distance along the first direction, and spaced apart from the first patch antenna pattern along a second direction normal to the first direction; a coupling pattern spaced apart from the first surface of the ground plane by a third distance along the first direction, and disposed between the first patch antenna pattern and the second patch antenna pattern along the second direction; a first feed via disposed between the ground pattern and the first patch antenna pattern, and disposed closer to an edge of the first patch antenna pattern that is farther from the first coupling pattern than a center of the first patch antenna pattern; and a second feed via disposed between the ground pattern and the second patch antenna pattern, and disposed closer to an edge of the second patch antenna pattern that is closer to the first coupling pattern than the center of the first patch antenna pattern.

The first distance may be equal to the second distance.

The first distance may not be equal to the second distance.

The first distance may be equal to the third distance.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
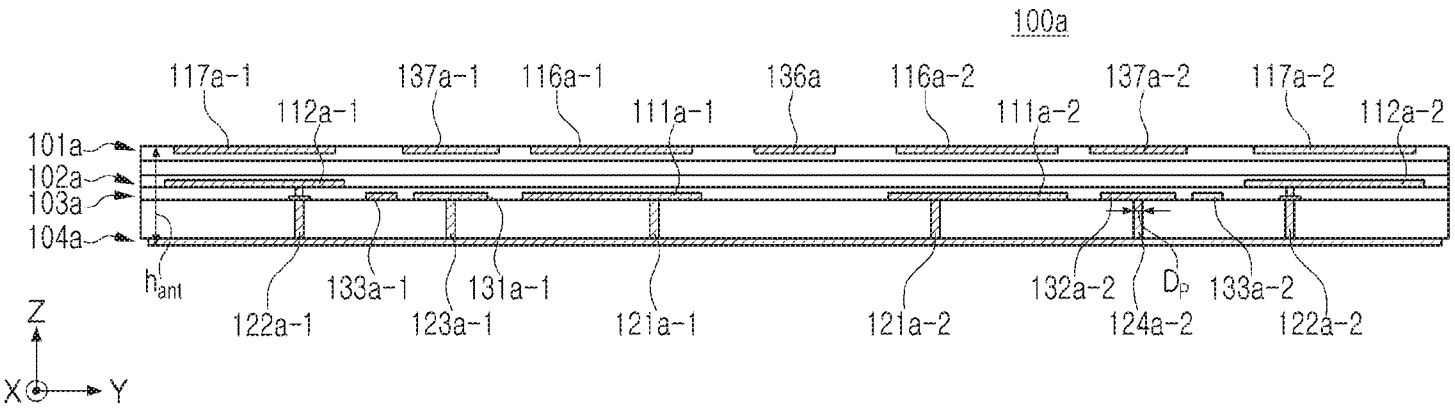
FIG. 1A is a side view of an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1A is a side view of an antenna apparatus according to an example. FIGS. 1B through 1E are plan views of an antenna device taken in a z direction in order in a-z direction according to an example.

An antenna apparatus 100*a* may have a stack structure in which a plurality of conductive layers and a plurality of dielectric layers are alternately disposed. At least some of the plurality of dielectric layers may be replaced with air. The stack structure may be implemented as a printed circuit substrate (PCB), but embodiment configuration thereof is not limited thereto.

Referring to FIGS. 1A through 1E, the antenna apparatus 100*a* may include a first conductive layer 101*a*, a second conductive layer 102*a*, a third conductive layer 103*a*, and a fourth conductive layer 104*a*. A spacing distance $h_{ant}$ between the first conductive layer 101*a* and the fourth conductive layer 104*a* may be appropriately adjusted.

For example, the first, second, third, and fourth conductive layers 101*a*, 102*a*, 103*a*, and 104*a* may be disposed in at least portions of upper surfaces or lower surfaces of the corresponding dielectric layers, respectively, to include a pre-designed conductive pattern or a pre-designed conductive plane, and may be connected to each other in upward and downward directions (e.g., z direction) through a conductive via. A width DP of the conductive via may be appropriately adjusted.

Referring to FIGS. 1A through 1E, the antenna apparatus 100*a* may include a ground plane 201*a*, first patch antenna patterns 111*a*-1 and 111*a*-2, second patch antenna patterns 112*a*-1 and 112*a*-2, second feed vias 122*a*-1, 122*a*-2, 122*a*-3, and 122*a*-4, first feed vias 121*a*-1, 121*a*-2, 121*a*-3, and 121*a*-4, first coupling patterns 131*a*-1, 131*a*-2, 132*a*-1, and 132*a*-2, second coupling patterns 133*a*-1 and 133*a*-2, and ground vias 123*a*-1, 123*a*-2, 124*a*-1, and 124*a*-2.

The ground plane 201*a* may be disposed on the fourth conductive layer 104*a*, and may work as a reference of impedance corresponding to a resonant frequency of each of the first and second patch antenna patterns 111*a*-1, 111*a*-2, 112*a*-1, and 112*a*-2.

The ground plane 201*a* may reflect a radio frequency (RF) signal radiated from the first and second patch antenna patterns 111*a*-1, 111*a*-2, 112*a*-1, and 112*a*-2, and accordingly, a direction in which radiation patterns of the first and second patch antenna patterns 111*a*-1, 111*a*-2, 112*a*-1, and 112*a*-2 are formed may be concentrated in a z direction, and gains of the first and second patch antenna patterns 111*a*-1, 111*a*-2, 112*a*-1, and 112*a*-2 may improve.

For example, the ground plane 201*a* may include at least one through-hole through which the first and second feed vias 121*a*-1, 121*a*-2, 121*a*-3, 121*a*-4, 122*a*-1, 122*a*-2, 122*a*-3, and 122*a*-4 penetrate. Accordingly, electrical lengths of feed paths provided to the first and second patch antenna patterns 111*a*-1, 111*a*-2, 112*a*-1, and 112*a*-2 may easily be shortened.

The first and second patch antenna patterns 111*a*-1, 111*a*-2, 112*a*-1, and 112*a*-2 may be disposed above and spaced apart from an upper surface of the ground plane 201*a*, and may be spaced apart from each other.

Each of the first and second patch antenna patterns 111*a*-1, 111*a*-2, 112*a*-1, and 112*a*-2 may have a bandwidth based on an intrinsic resonant frequency determined in accordance with an intrinsic element (e.g., a shape, a size, a thickness, a spacing distance, a dielectric constant of a dielectric layer, or others) and an extrinsic resonant frequency determined in accordance with an electromagnetic coupling with an adjacent conductive structure.

When a frequency of an RF signal is included in the bandwidth described above, the first and second patch antenna patterns 111*a*-1, 111*a*-2, 112*a*-1, and 112*a*-2 may receive an RF signal from the first and second feed vias 121*a*-1, 121*a*-2, 121*a*-3, 121*a*-4, 122*a*-1, 122*a*-2, 122*a*-3, and 122*a*-4, and may remotely transmit the RF signal in the z direction, or may transfer a remotely received RF signal to the first and second feed vias 121*a*-1, 121*a*-2, 121*a*-3, 121*a*-4, 122*a*-1, 122*a*-2, 122*a*-3, and 122*a*-4. The first and second feed vias 121*a*-1, 121*a*-2, 121*a*-3, 121*a*-4, 122*a*-1, 122*a*-2, 122*a*-3, and 122*a*-4 may provide an electrical connection path between an integrated circuit (IC) and the first and second patch antenna patterns 111*a*-1, 111*a*-2, 112*a*-1, and 112*a*-2, and may work as transmission lines of an RF signal.

The second feed vias 122*a*-1, 122*a*-2, 122*a*-3, and 122*a*-4 may be configured to provide second feed paths of the second patch antenna patterns 112*a*-1 and 112*a*-2 through points of the second patch antenna patterns 112*a*-1 and 112*a*-2 disposed adjacent to edges of the second patch antenna patterns 112*a*-1 and 112*a*-2 in a first direction (e.g., y direction) towards the first patch antenna patterns 111*a*-1 and 111*a*-2.

The first feed vias 121*a*-1, 121*a*-2, 121*a*-3, and 121*a*-4 may be configured to provide first feed paths of the first patch antenna patterns 111*a*-1 and 111*a*-2 through points of the first patch antenna patterns 111*a*-1 and 111*a*-2 disposed adjacent to edges of the first patch antenna patterns 111*a*-1 and 111*a*-2 in the first direction (e.g., y direction).

Upper surfaces of the first and second patch antenna patterns 111*a*-1, 111*a*-2, 112*a*-1, and 112*a*-2 may work as spaces in which a surface current flows, and electromagnetic energy corresponding to the surface current may be radiated to air in a normal direction of upper surfaces of the first and second patch antenna patterns 111*a*-1, 111*a*-2, 112*a*-1, and 112*a*-2 in accordance with resonance of the first and second patch antenna patterns 111*a*-1, 111*a*-2, 112*a*-1, and 112*a*-2. Each of positions in which the first and second feed vias 121*a*-1, 121*a*-2, 121*a*-3, 121*a*-4, 122*a*-1, 122*a*-2, 122*a*-3, and 122*a*-4 provide first and second feed paths may work as a reference point of the surface current.

As the direction in which the first feed vias 121*a*-1, 121*a*-2, 121*a*-3, and 121*a*-4 are adjacent to the edges of the first patch antenna patterns 111*a*-1 and 111*a*-2 and the direction in which the second feed vias 122*a*-1, 122*a*-2, 122*a*-3, and 122*a*-4 are adjacent to the edges of the second patch antenna patterns 112*a*-1 and 112*a*-2 are the first direction, the direction in which a first surface current of the first patch antenna patterns 111*a*-1 and 111*a*-2 flows may be substantially the same as a direction in which a second surface current of the second patch antenna patterns 112*a*-1 and 112*a*-2 flows.

The direction in which the first and second surface current flow may correspond to a direction of an electrical field and a direction of a magnetic field, formed when the first and second patch antenna patterns 111*a*-1, 111*a*-2, 112*a*-1, and 112*a*-2 remotely transmit and receive an RF signal.

As the direction in which the first surface current flows is the same as the direction in which the second current surface flows, the directions of first and second electrical fields and first and second magnetic fields, formed when the first and second patch antenna patterns 111*a*-1, 111*a*-2, 112*a*-1, and 112*a*-2 remotely transmit and receive an RF signal, may be substantially the same.

Accordingly, the first and second radiation patterns of the first and second patch antenna patterns 111*a*-1, 111*a*-2, 112*a*-1, and 112*a*-2 may electromagnetically overlap each other in an efficient manner. Accordingly, an overall gain of the antenna apparatus 100*a* may improve. The higher the number of the first and second patch antenna patterns 111*a*-1, 111*a*-2, 112*a*-1, and 112*a*-2, the more the gain may increase, and the antenna apparatus 100*a* may improve a gain for a size.

The first coupling patterns 131*a*-1, 131*a*-2, 132*a*-1, and 132*a*-2 may be spaced apart from the first and second patch antenna patterns 111*a*-1, 111*a*-2, 112*a*-1, and 112*a*-2 and may be disposed among the first and second patch antenna patterns 111*a*-1, 111*a*-2, 112*a*-1, and 112*a*-2.

The first coupling patterns 131*a*-1, 131*a*-2, 132*a*-1, and 132*a*-2 may be electromagnetically coupled to the first patch antenna patterns 111*a*-1 and 111*a*-2, and may thus provide impedance to the first patch antenna patterns 111*a*-1 and 111*a*-2. The impedance may affect a resonant frequency of the first patch antenna patterns 111*a*-1 and 111*a*-2, and accordingly, the first patch antenna patterns 111*a*-1 and 111*a*-2 may increase a gain or may broaden a bandwidth in accordance with the electromagnetic coupling of the first coupling patterns 131*a*-1, 131*a*-2, 132*a*-1, and 132*a*-2.

As the first coupling patterns 131*a*-1, 131*a*-2, 132*a*-1, and 132*a*-2 may be disposed among the first and second patch antenna patterns 111*a*-1, 111*a*-2, 112*a*-1, and 112*a*-2, a surface current flowing in the first patch antenna patterns 111*a*-1 and 111*a*-2 may flow to the first coupling patterns 131*a*-1, 131*a*-2, 132*a*-1, and 132*a*-2 through electromagnetic coupling. The first coupling patterns 131*a*-1, 131*a*-2, 132*a*-1, and 132*a*-2 may additionally provide an area in which the surface current flows.

Properties of the first surface current flowing in the first patch antenna patterns 111*a*-1 and 111*a*-2 may be affected by the first coupling patterns 131*a*-1, 131*a*-2, 132*a*-1, and 132*a*-2.

Positions of the first patch antenna patterns 111*a*-1 and 111*a*-2 electrically connected to the first feed vias 121*a*-1, 121*a*-2, 121*a*-3, and 121*a*-4 may be disposed adjacent to edges of the first patch antenna patterns 111*a*-1 and 111*a*-2 in a direction in which the positions are spaced apart from the first coupling patterns 131*a*-1, 131*a*-2, 132*a*-1, and 132*a*-2, and positions of the second patch antenna patterns 112*a*-1 and 112*a*-2 electrically connected to the second feed vias 122*a*-1, 122*a*-2, 122*a*-3, and 122*a*-4 may be disposed adjacent to edges of the second patch antenna patterns 112*a*-1 and 112*a*-2 in a direction in which the positions are adjacent to the first coupling patterns 131*a*-1, 131*a*-2, 132*a*-1, and 132*a*-2.

The positions in which the first and second feed vias 121*a*-1, 121*a*-2, 121*a*-3, 121*a*-4, 122*a*-1, 122*a*-2, 122*a*-3, and 122*a*-4 provide the first and second feed paths may work as a reference point of the surface current. Accordingly, a first electromagnetic effect from the first coupling patterns 131*a*-1, 131*a*-2, 132*a*-1, and 132*a*-2 affecting the first surface current of the first patch antenna patterns 111*a*-1 and 111*a*-2 may be different from a second electromagnetic effect from the first coupling patterns 131*a*-1, 131*a*-2, 132*a*-1, and 132*a*-2 affecting the second surface current of the second patch antenna patterns 112*a*-1 and 112*a*-2.

As the antenna apparatus 100*a* includes a structure which may alleviate a difference between the first electromagnetic effect and the second electromagnetic effect, efficiency of electromagnetic overlap between the first and second radiation patterns of the first and second patch antenna patterns 111*a*-1, 111*a*-2, 112*a*-1, and 112*a*-2 may improve, and an improved gain for a size may be obtained.

The ground vias 123*a*-1, 123*a*-2, 124*a*-1, and 124*a*-2 may electrically connect the first coupling patterns 131*a*-1, 131*a*-2, 132*a*-1, and 132*a*-2 to the ground plane 201*a*. Accordingly, the ground vias 123*a*-1, 123*a*-2, 124*a*-1, and 124*a*-2 may work as an inductance element of a resonant frequency of the first patch antenna patterns 111*a*-1 and 111*a*-2.

The second coupling patterns 133*a*-1 and 133*a*-2 may be spaced apart from the second patch antenna patterns 112*a*-1 and 112*a*-2 and the first coupling patterns 131*a*-1, 131*a*-2, 132*a*-1, and 132*a*-2, may be disposed between the second patch antenna patterns 112*a*-1 and 112*a*-2 and the first coupling patterns 131*a*-1, 131*a*-2, 132*a*-1, and 132*a*-2, and may be separated from the ground plane 201*a*. Accordingly, the second coupling patterns 133*a*-1 and 133*a*-2 may work as a capacitance element of a resonant frequency of the first patch antenna patterns 111*a*-1 and 111*a*-2.

In a combination structure of the first coupling patterns 131*a*-1, 131*a*-2, 132*a*-1, and 132*a*-2, the ground vias 123*a*-1, 123*a*-2, 124*a*-1, and 124*a*-2, and the second coupling patterns 133*a*-1 and 133*a*-2, a first structure adjacent to the first patch antenna patterns 111*a*-1 and 111*a*-2 and a second structure adjacent to the second patch antenna patterns 112*a*-1 and 112*a*-2 may be asymmetrical to each other. Accordingly, the asymmetrical structure may alleviate a difference between the first electromagnetic effect from the first coupling patterns 131*a*-1, 131*a*-2, 132*a*-1, and 132*a*-2 affecting the first surface current of the first patch antenna patterns 111*a*-1 and 111*a*-2 and the second electromagnetic effect from the first coupling patterns 131*a*-1, 131*a*-2, 132*a*-1, and 132*a*-2 affecting the second patch antenna patterns 112*a*-1 and 112*a*-2.

Accordingly, the antenna apparatus 100*a* may improve efficiency of electromagnetic overlap between the first and second radiation patterns of the first and second patch antenna patterns 111*a*-1, 111*a*-2, 112*a*-1, and 112*a*-2, and may obtain an improved gain for a size.

Referring to FIGS. 1A through 1E, the number of the first feed vias 121*a*-1, 121*a*-2, 121*a*-3, and 121*a*-4 electrically connected to each of first patch antenna patterns 111*a*-1 and 111*a*-2 may be two or more, and the number of the second feed vias 122*a*-1, 122*a*-2, 122*a*-3, and 122*a*-4 electrically connected to each of the second patch antenna patterns 112*a*-1 and 112*a*-2 may be two or more.

First RF signals transferred through some of the first feed vias 121*a*-1, 121*a*-2, 121*a*-3, and 121*a*-4 and second RF signals transferred through the other first feed vias of the first feed vias 121*a*-1, 121*a*-2, 121*a*-3, and 121*a*-4 may be in a mutually polarized relationship, and first RF signals transferred through some of the second feed vias 122*a*-1, 122*a*-2, 122*a*-3, and 122*a*-4 and second RF signals transferred through the other second feed vias of the second feed vias 122*a*-1, 122*a*-2, 122*a*-3, and 122*a*-4 may be in a mutually polarized relationship. A portion of communication data included in RF signals may be included in the first RF signals, and the other portion of communication data may be included in the second RF signals. Accordingly, the more the number of the first and second feed vias 121*a*-1, 121*a*-2, 121*a*-3, 121*a*-4, 122*a*-1, 122*a*-2, 122*a*-3, and 122*a*-4 electrically connected to a single patch antenna pattern of the first and second patch antenna patterns 111*a*-1, 111*a*-2, 112*a*-1, and 112*a*-2, the more the communication data transmission and reception rate of the antenna apparatus 100*a* may increase.

The plurality of first feed vias 121*a*-1, 121*a*-2, 121*a*-3, and 121*a*-4 may be disposed adjacent to edges of the first patch antenna patterns 111*a*-1 and 111*a*-2 in a direction in which the first feed vias 121*a*-1, 121*a*-2, 121*a*-3, and 121*a*-4 are spaced apart from adjacent first coupling patterns 131*a*-1, 131*a*-2, 132*a*-1, and 132*a*-2, respectively, and the second feed vias 122*a*-1, 122*a*-2, 122*a*-3, and 122*a*-4 may be disposed adjacent to edges of the second patch antenna patterns 112*a*-1 and 112*a*-2 in a direction in which the second feed vias 122*a*-1, 122*a*-2, 122*a*-3, and 122*a*-4 are adjacent to adjacent first coupling patterns 131*a*-1, 131*a*-2, 132*a*-1, and 132*a*-2.

As for the first coupling patterns 131*a*-1, 131*a*-2, 132*a*-1, and 132*a*-2, two or more first coupling patterns 131*a*-1, 131*a*-2, 132*a*-1, and 132*a*-2, spaced apart from each other, may be disposed in each of spaces among the first and second patch antenna patterns 111*a*-1, 111*a*-2, 112*a*-1, and 112*a*-2.

Accordingly, a surface current corresponding to the first RF signal and a surface current corresponding to the second RF signal may flow towards the first coupling patterns 131*a*-1, 131*a*-2, 132*a*-1, and 132*a*-2 spaced apart from each other. Accordingly, an electromagnetic effect between the first RF signal and the second RF signal may be reduced, and a gain of the first and second patch antenna patterns 111*a*-1, 111*a*-2, 112*a*-1, and 112*a*-2 may improve.

Referring to FIGS. 1A through 1E, the ground vias 123*a*-1, 123*a*-2, 124*a*-1, and 124*a*-2 may include a plurality of ground vias 123*a*-1, 123*a*-2, 124*a*-1, and 124*a*-2 electrically connected to a plurality of first coupling patterns 131*a*-1, 131*a*-2, 132*a*-1, and 132*a*-2, respectively, disposed in the spaces among the first and second patch antenna patterns 111*a*-1, 111*a*-2, 112*a*-1, and 112*a*-2, respectively.

For example, a length L6 (in the x direction) of the second coupling pattern may be greater than a length L5 (in the x direction) of each of the plurality of first coupling patterns, and a gap D5 (in the x direction) between the plurality of first coupling patterns may be less than a gap D6 (in the y direction) between the plurality of first coupling patterns and the second coupling pattern.

Accordingly, a surface current corresponding to the first RF signal and a surface current corresponding to the second RF signal may flow towards the plurality of first coupling patterns 131*a*-1, 131*a*-2, 132*a*-1, and 132*a*-2 spaced apart from each other. Accordingly, an electromagnetic effect between the first RF signal and the second RF signal may be reduced, and gains of the first and second patch antenna patterns 111*a*-1, 111*a*-2, 112*a*-1, and 112*a*-2 may improve.

For example, a length L4-1 and/or a width W4-1 of the first patch antenna pattern may be greater than the length L5 of the first coupling pattern, and may be greater than the length L6 of the second coupling pattern. A length L4-2 and a width W4-2 of the second patch antenna pattern may be greater than the length L5, and may be greater than the length L6.

Accordingly, efficiency of electromagnetic coupling between the first patch antenna patterns 111*a*-1 and 111*a*-2 and the first coupling patterns 131*a*-1, 131*a*-2, 132*a*-1, and 132*a*-2 and the second coupling patterns 133*a*-1 and 133*a*-2 may increase. Accordingly, a gain of the first patch antenna patterns 111*a*-1 and 111*a*-2 may improve.

For example, a width W6 (in the y direction) of the second coupling pattern may be less than a width W5 (in the y direction) of the first coupling pattern, the gap D6 between the first and second coupling patterns may be less than a gap D4 (in the y direction) between the first coupling pattern and the first patch antenna pattern, and may be less than a gap between the second coupling pattern and the second patch antenna pattern.

Accordingly, in a combination structure of the first coupling patterns 131a-1, 131a-2, 132a-1, and 132a-2, the ground vias 123a-1, 123a-2, 124a-1, and 124a-2, and the second coupling patterns 133a-1 and 133a-2, a first structure adjacent to the first patch antenna patterns 111a-1 and 111a-2 and a second structure adjacent to the second patch antenna patterns 112a-1 and 112a-2 may be asymmetrical to each other. Accordingly, a difference in electromagnetic boundary condition among the first and second patch antenna patterns 111a-1, 111a-2, 112a-1, and 112a-2 may be efficiently alleviated. Accordingly, the antenna apparatus 100a may obtain an improved gain for a size.

Figure 1B:
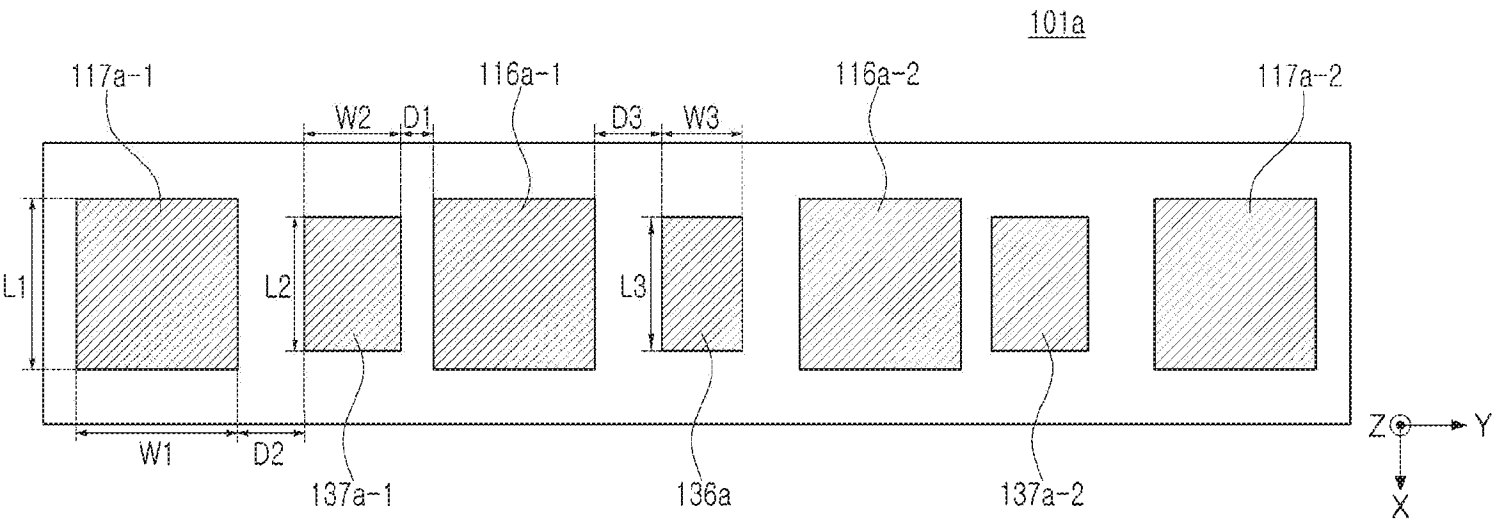
FIGS. 1B, 1C, 1D, and 1E are plan views of an antenna device taken in a z direction in order in a-z direction according to an example.
Figure 1C:
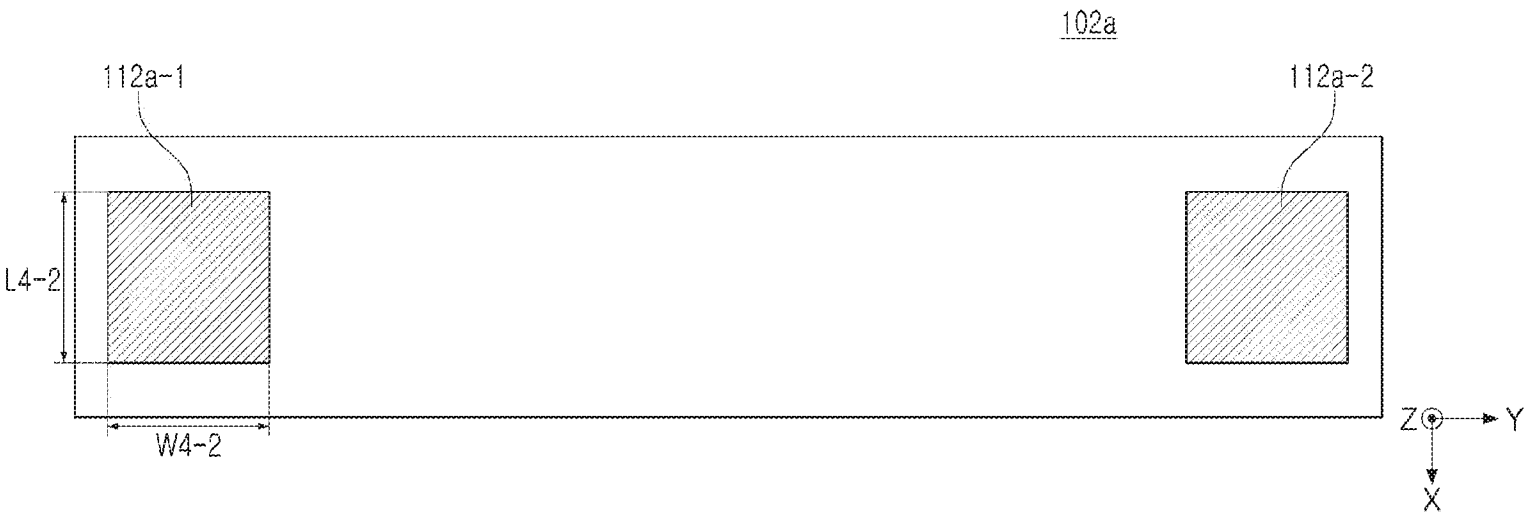

As shown in FIGS. 1A and 1B, at least one of first upper patch patterns 116a-1 and 116a-2, second upper patch patterns 117a-1 and 117a-2, and upper coupling patterns 137a-1 and 137a-2, included in the antenna apparatus 100a, may be disposed on the first conductive layer 101a.

As the first and second patch antenna patterns 111a-1, 111a-2, 112a-1, and 112a-2 are disposed on the second conductive layer 102a or the third conductive layer 103a, the first upper patch patterns 116a-1 and 116a-2 may be disposed above and spaced apart from upper surfaces of the first patch antenna patterns 111a-1 and 111a-2, and the second upper patch patterns 117a-1 and 117a-2 may be disposed above and spaced apart from upper surfaces of the second patch antenna patterns 112a-1 and 112a-2.

As the first and second upper patch patterns 116a-1, 116a-2, 117a-1, and 117a-2 may be electromagnetically coupled to the first and second patch antenna patterns 111a-1, 111a-2, 112a-1, and 112a-2, additional impedance may be provided to the first and second patch antenna patterns 111a-1, 111a-2, 112a-1, and 112a-2. The first and second patch antenna patterns 111a-1, 111a-2, 112a-1, and 112a-2 may have an additional resonant frequency based on the additional impedance, and may thus have a broadened bandwidth.

As the first coupling patterns 131a-1, 131a-2, 132a-1, and 132a-2 are disposed on the second conductive layer 102a or the third conductive layer 103a, the upper coupling patterns 137a-1 and 137a-2 may be disposed above and spaced apart from the upper surfaces of the first coupling patterns 131a-1, 131a-2, 132a-1, and 132a-2.

As the upper coupling patterns 137a-1 and 137a-2 are electromagnetically coupled to the first and second upper patch patterns 116a-1, 116a-2, 117a-1, and 117a-2, the upper coupling patterns 137a-1 and 137a-2 may provide additional impedance to the first and second patch antenna patterns 111a-1, 111a-2, 112a-1, and 112a-2.

As the upper coupling patterns 137a-1 and 137a-2 are electromagnetically coupled to the first coupling patterns 131a-1, 131a-2, 132a-1, and 132a-2, the upper coupling patterns 137a-1 and 137a-2 may more greatly affect the first patch antenna patterns 111a-1 and 111a-2 than the second patch antenna patterns 112a-1 and 112a-2.

For example, the second coupling patterns 133a-1 and 133a-2 may be configured to not overlap the upper coupling patterns 137a-1 and 137a-2 in upward and downward directions (e.g., z direction). For example, a spacing distance D1 (in the y direction) between the upper coupling pattern and the first upper patch pattern may be less than a spacing distance D2 (in the y direction) between the upper coupling pattern and the second upper patch pattern.

Accordingly, a difference in electromagnetic boundary condition among the first and second patch antenna patterns 111a-1, 111a-2, 112a-1, and 112a-2 may be efficiently alleviated, and the antenna apparatus 100a may obtain improved gain for size.

A length L1 and a width W1 of the second upper path pattern and a length L2 and a width W2 of the upper coupling pattern may be appropriately adjusted.

Figure 1D:
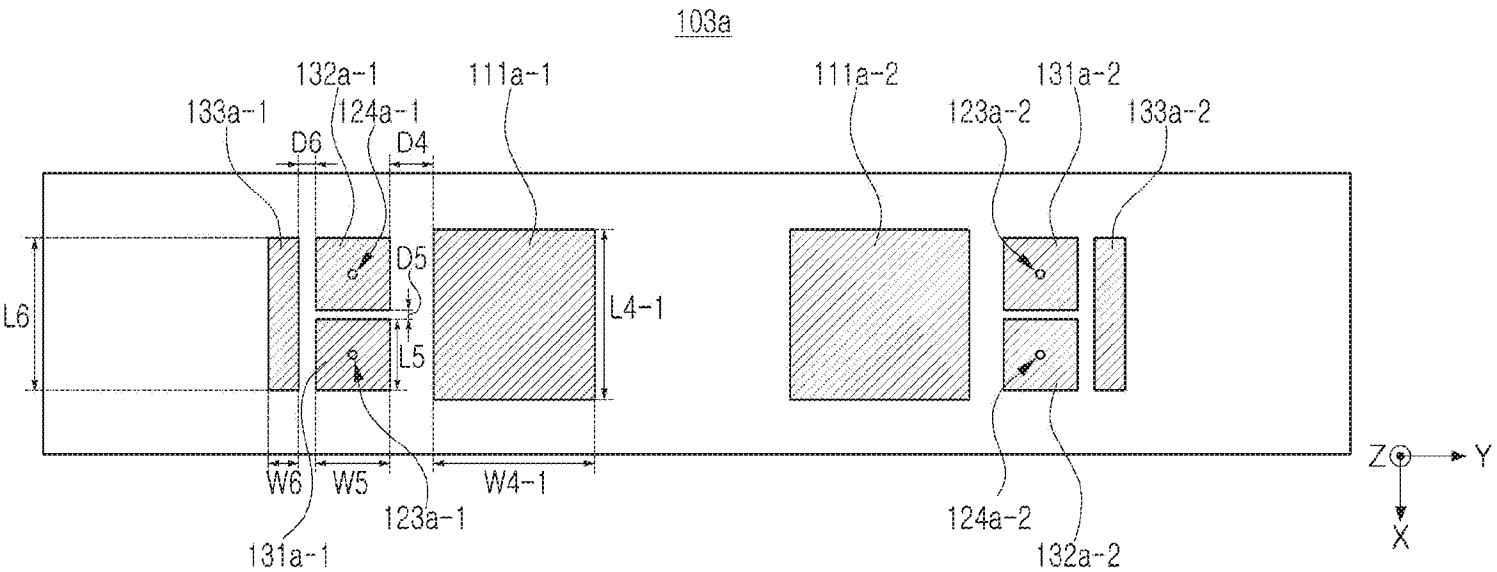

Referring to FIGS. 1A, 10, and 1D, the first patch antenna patterns 111a-1 and 111a-2 may be disposed on the third conductive layer 103a, and the second patch antenna patterns 112a-1 and 112a-2 may be disposed on the second conductive layer 102a.

The second patch antenna patterns 112a-1 and 112a-2 may be disposed on a level higher than a level of the first patch antenna patterns 111a-1 and 111a-2, and a spacing distance between the second patch antenna patterns 112a-1 and 112a-2 and the upper coupling patterns 137a-1 and 137a-2 may be less than a spacing distance between the first patch antenna patterns 111a-1 and 111a-2 and the first upper patch patterns 116a-1 and 116a-2.

Accordingly, as compared to the first patch antenna patterns 111a-1 and 111a-2, the second patch antenna patterns 112a-1 and 112a-2 may be electromagnetically coupled to each other more intensively in upward and downward directions (e.g., z direction) than in a horizontal direction (e.g., y direction). Accordingly, the second patch antenna patterns 112a-1 and 112a-2 may be electromagnetically connected to the first coupling patterns 131a-1, 131a-2, 132a-1, and 132a-2 in a bypass manner through the second upper patch patterns 117a-1 and 117a-2 and the upper coupling patterns 137a-1 and 137a-2. Accordingly, a difference in electromagnetic boundary conditions among the first and second patch antenna patterns 111a-1, 111a-2, 112a-1, and 112a-2 may be efficiently alleviated, and the antenna apparatus 100a may thus obtain improved gain for size.

Referring to FIGS. 1A and 1D, a space between the first patch antenna patterns 111a-1 and 111a-2 on the third conductive layer 103a may be formed of a non-conductive material or air.

As each of the first and second feed vias 121a-1, 121a-2, 121a-3, 121a-4, 122a-1, 122a-2, 122a-3, and 122a-4 is disposed adjacent to the space between the first patch antenna patterns 111a-1 and 111a-2, the first and second surface currents of the first and second patch antenna patterns 111a-1, 111a-2, 112a-1, and 112a-2 may flow in a direction in which the first and second surface currents are further away from the space between the first patch antenna patterns 111a-1 and 111a-2.

As the space between the first patch antenna patterns 111a-1 and 111a-2 on the third conductive layer 103a is formed of a non-conductive material or air, the dispersion of directions of the first and second surface currents may be prevented. Accordingly, the first and second radiation patterns of the first and second patch antenna patterns 111a-1, 111a-2, 112a-1, and 112a-2 may electromagnetically overlap each other in an efficient manner, and the antenna apparatus 100a may obtain improved gain for size.

Referring to FIGS. 1A and 1B, a third upper patch pattern 136a included in the antenna apparatus 100a may be disposed on the first conductive layer 101a.

The third upper patch pattern 136a may be disposed between the first upper patch patterns 116a-1 and 116a-2, and may be electromagnetically coupled to the first upper patch patterns 116a-1 and 116a-2. Accordingly, the first patch antenna patterns 111a-1 and 111a-2 may be provided with additional impedance from the third upper patch pattern 136*a*, thereby obtaining a broadened bandwidth.

A length L3 and a width W3 of the third upper patch pattern and a spacing distance D3 (in the y direction) to the first upper patch pattern may be appropriately adjusted.

Figure 1E:
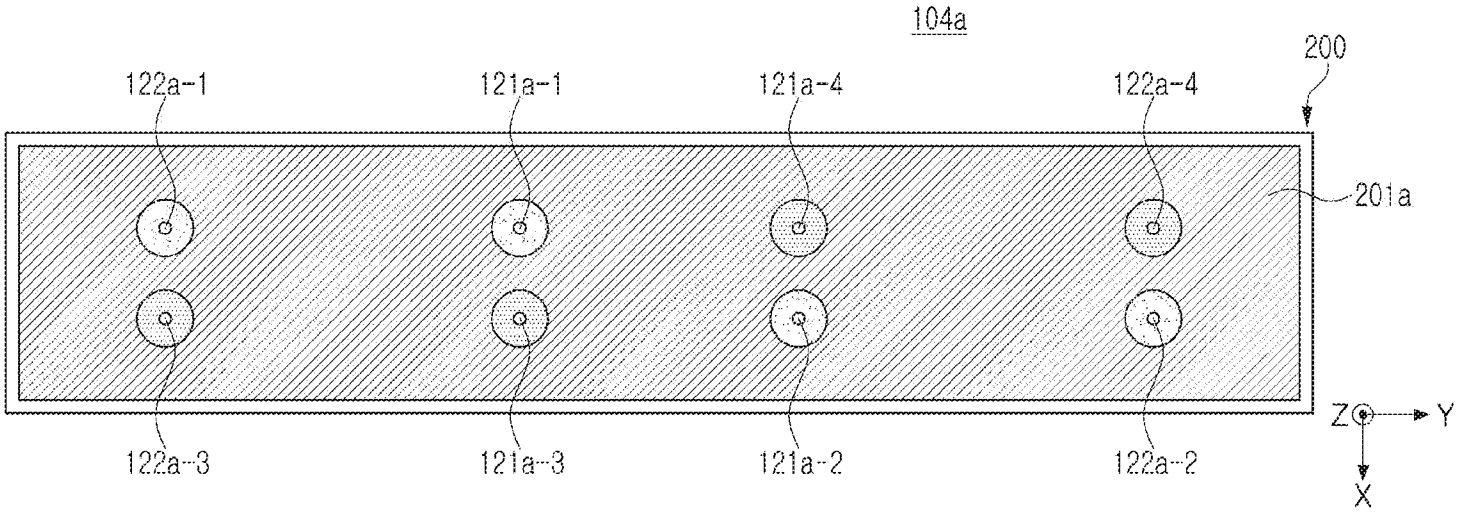
Figure 1F:
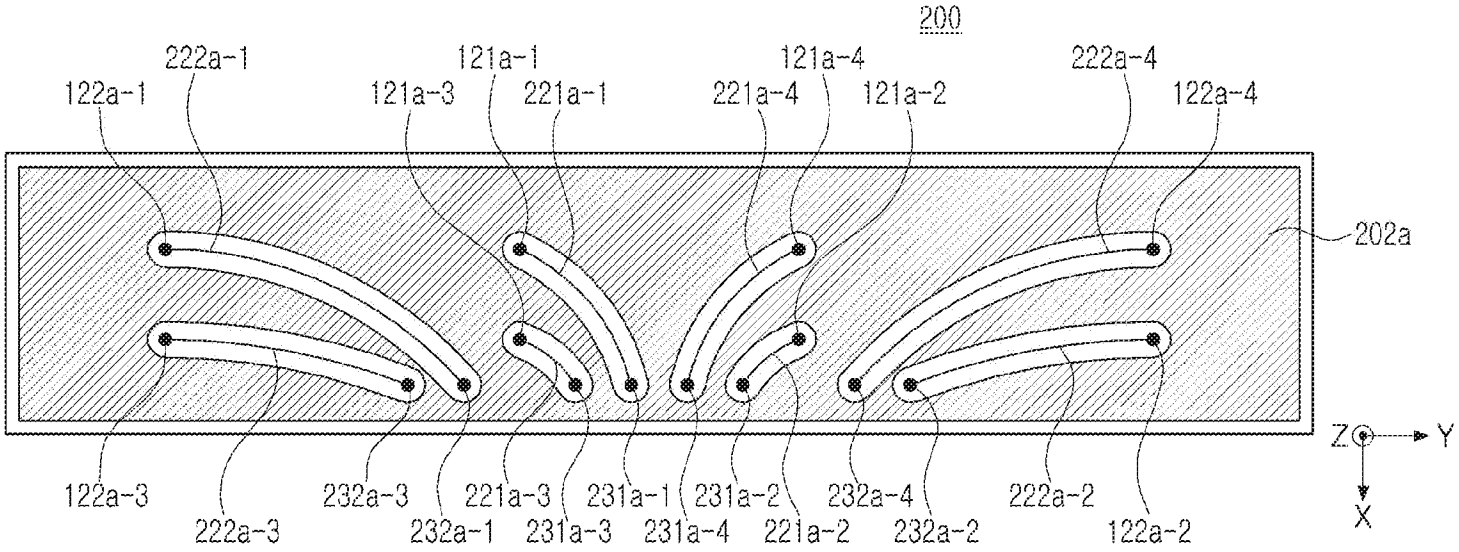
FIG. 1F is a plan view of a structure disposed lower than a ground plane of an antenna apparatus according to an example.

FIG. 1F is a plan view of a structure disposed lower than a ground plane of an antenna apparatus according to an example.

Referring to FIG. 1F, a ground plane 202*a* of a connection member 200 included in an antenna apparatus in the example may be disposed on a level lower than a level of the ground plane 201*a* illustrated in FIG. 1E, and may be configured to surround each of first and second feed lines 221*a*-1, 221*a*-2, 221*a*-3, 221*a*-4, 222*a*-1, 222*a*-2, 222*a*-3, and 222*a*-4.

First respective ends of the first and second feed lines 221*a*-1, 221*a*-2, 221*a*-3, 221*a*-4, 222*a*-1, 222*a*-2, 222*a*-3, and 222*a*-4 may be connected to the first and second feed vias 121*a*-1, 121*a*-2, 121*a*-3, 121*a*-4, 122*a*-1, 122*a*-2, 122*a*-3, and 122*a*-4, respectively, and the other (second) respective ends of the first and second feed lines 221*a*-1, 221*a*-2, 221*a*-3, 221*a*-4, 222*a*-1, 222*a*-2, 222*a*-3 may be connected to first and second wiring vias 231*a*-1, 231*a*-2, 231*a*-3, 231*a*-4, 232*a*-1, 232*a*-2, 232*a*-3, and 232*a*-4, respectively.

The first and second wiring vias 231*a*-1, 231*a*-2, 231*a*-3, 231*a*-4, 232*a*-1, 232*a*-2, 232*a*-3, and 232*a*-4 may electrically connect the first and second feed lines 221*a*-1, 221*a*-2, 221*a*-3, 221*a*-4, 222*a*-1, 222*a*-2, 222*a*-3, and 222*a*-4 to an IC.

Figure 2A:
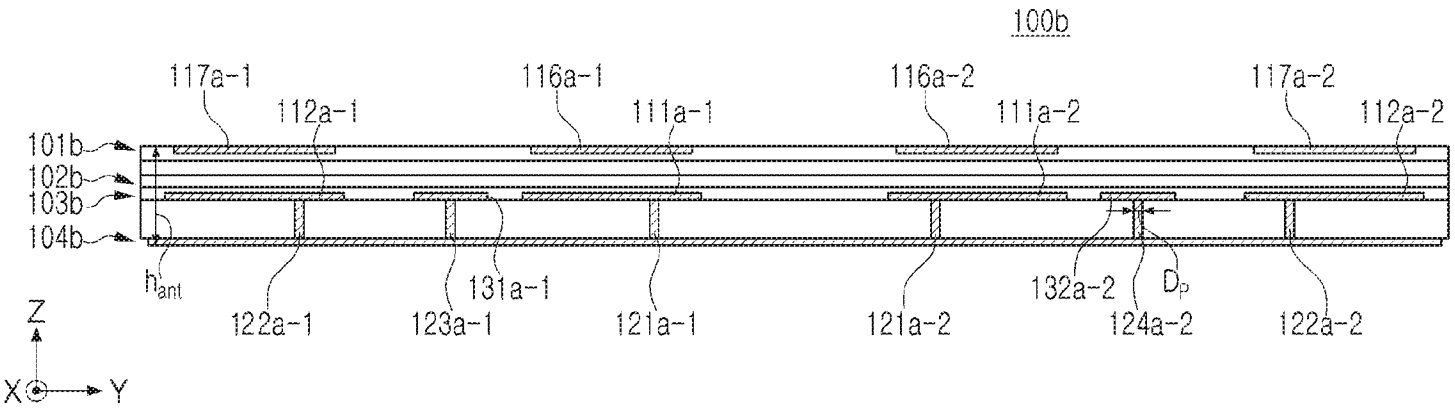
FIG. 2A is a side view of a modified structure of an antenna apparatus according to an example.
Figure 2B:
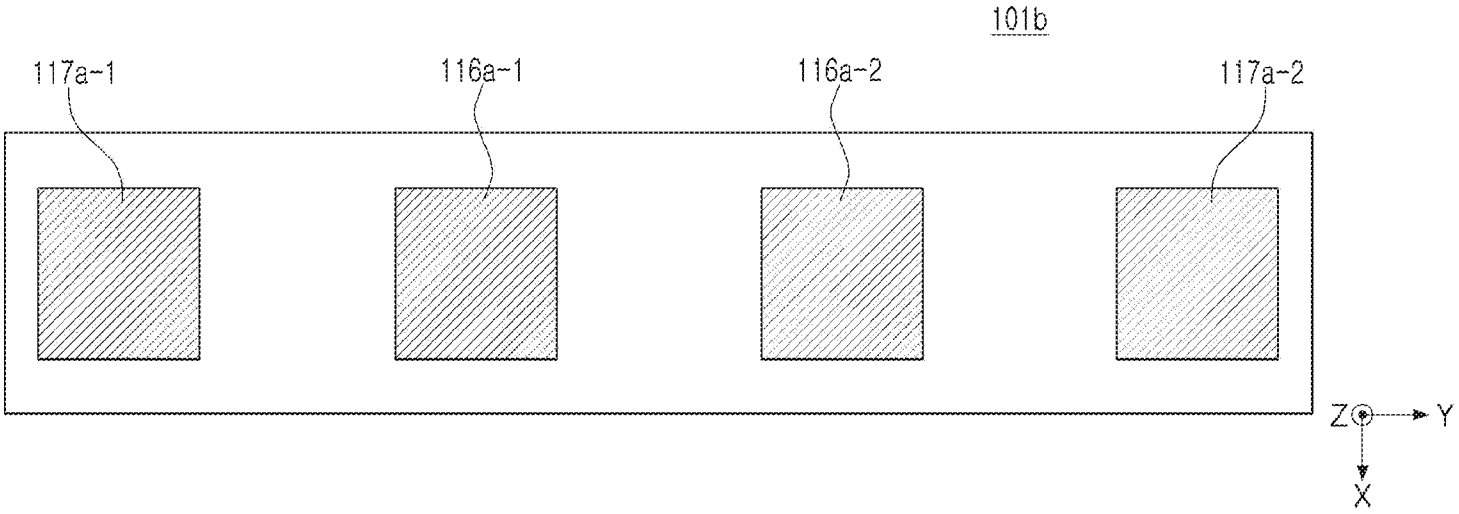
FIGS. 2B and 2C are plan views of a modified structure of an antenna apparatus according to an example.
Figure 2C:
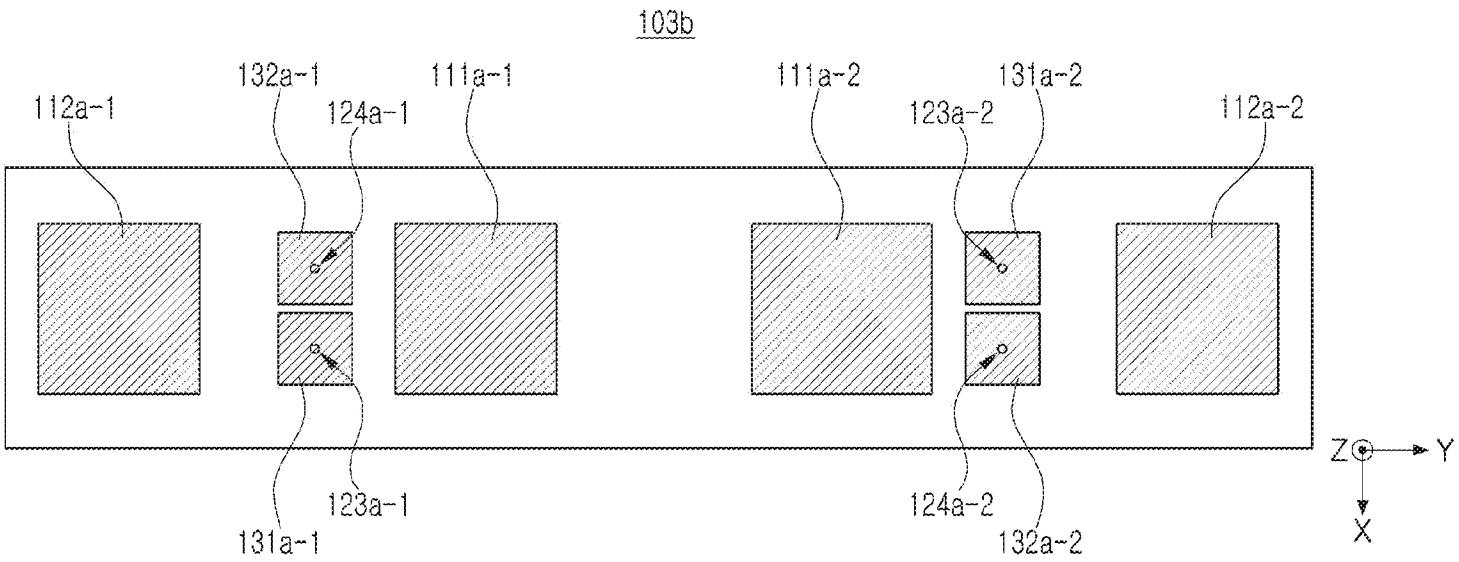

FIG. 2A is a side view of a modified structure of an antenna apparatus according to an example. FIGS. 2B and 2C are plan views of a modified structure of an antenna apparatus according to an example.

Referring to FIGS. 2A through 2C, an antenna apparatus 100*b* may include a first conductive layer 101*b*, a second conductive layer 102*b*, a third conductive layer 103*b*, and a fourth conductive layer 104*b*, and at least one of a second coupling pattern, an upper coupling pattern, and a third upper patch pattern may not be provided in various examples.

In the antenna apparatus 100*b*, first patch antenna patterns 111*a*-1 and 111*a*-2 and second patch antenna patterns 112*a*-1 and 112*a*-2 may be disposed on the same level, and may be disposed on a third conductive layer 103*b*. The configuration in which each of a plurality of elements are disposed on the same level may indicate that the plurality of elements overlap one another in a horizontal direction.

Figure 3A:
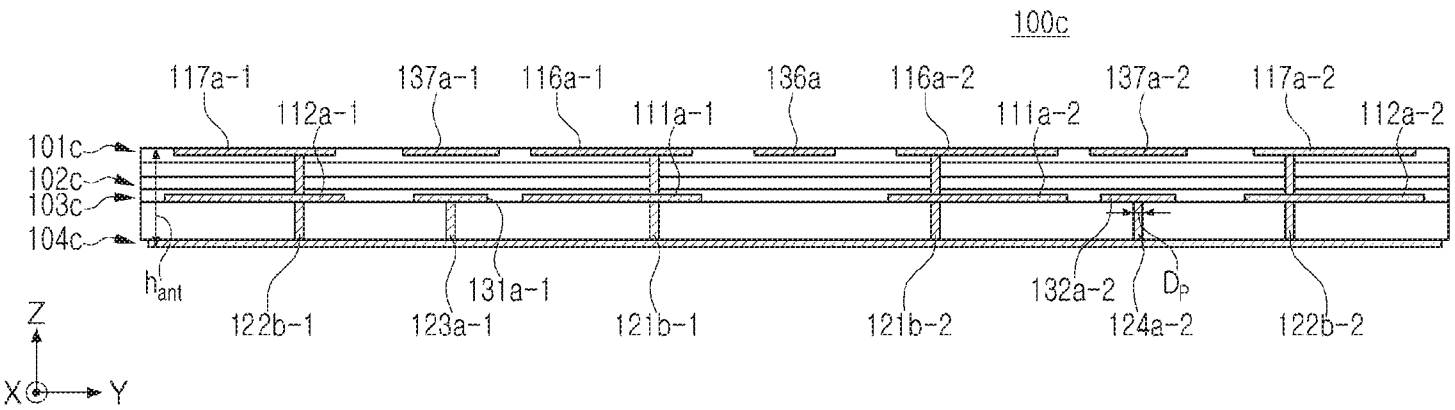
FIG. 3A is a side view of a modified structure of an antenna apparatus according to an example.
Figure 3B:
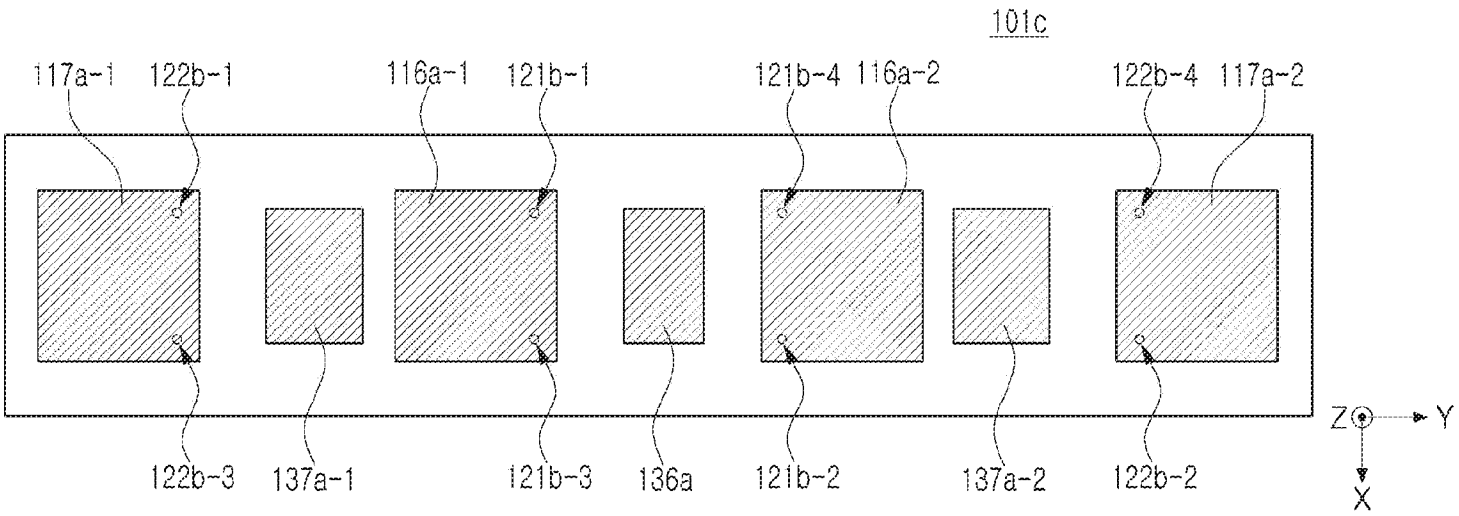
FIGS. 3B and 3C are plan views of a modified structure of an antenna apparatus according to an example.
Figure 3C:
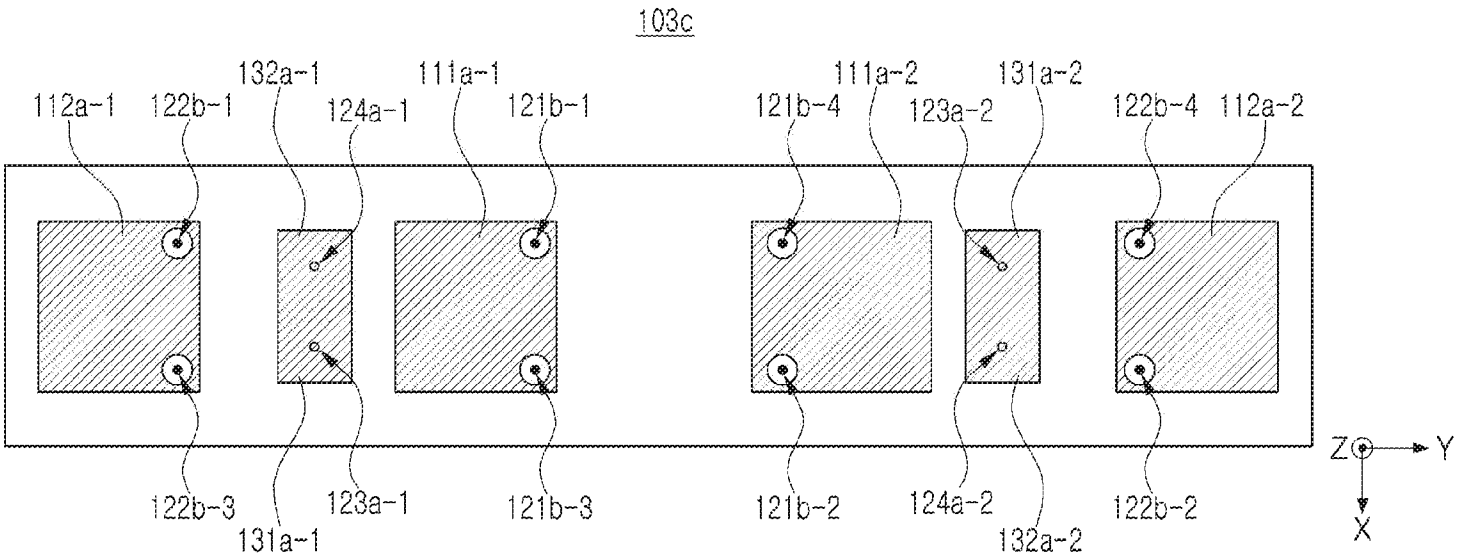

FIG. 3A is a side view of a modified structure of an antenna apparatus according to an example. FIGS. 3B and 3C are plan views of a modified structure of an antenna apparatus according to an example.

Referring to FIGS. 3A through 3C, an antenna apparatus 100*c* may include a first conductive layer 101*c*, a second conductive layer 102*c*, a third conductive layer 103*c*, and a fourth conductive layer 104*c*, and may be configured to have a plurality of frequency bands (e.g., 28 GHz and 39 GHz).

In various examples, first and second feed vias 121*b*-1, 121*b*-2, 121*b*-3, 121*b*-4, 122*b*-1, 122*b*-2, 122*b*-3, and 122*b*-4 may provide transmission paths of an RF signal having a second frequency band with respect to first and second upper patch patterns 116*a*-1, 116*a*-2, 117*a*-1, and 117*a*-2, and may provide transmission paths of an RF signal having a first frequency band with respect to first and second patch antenna patterns 111*a*-1, 111*a*-2, 112*a*-1, and 112*a*-2. For example, a size of some of the first and second upper patch patterns 116*a*-1, 116*a*-2, 117*a*-1, and 117*a*-2 may be less than a size of others of the first and second upper patch patterns 116*a*-1, 116*a*-2, 117*a*-1, and 117*a*-2, and the first and second upper patch patterns 116*a*-1, 116*a*-2, 117*a*-1, and 117*a*-2 may have through-holes which the first and second feed vias 121*b*-1, 121*b*-2, 121*b*-3, 121*b*-4, 122*b*-1, 122*b*-2, 122*b*-3, and 122*b*-4 penetrate.

Figure 4A:
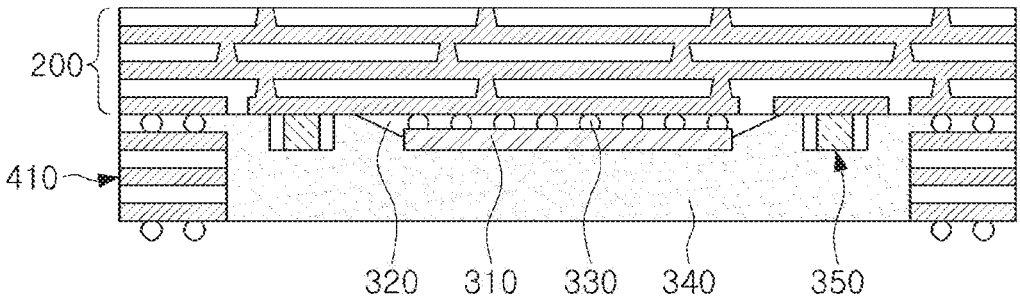
FIGS. 4A and 4B are side views of a connection member on which a ground plane is stacked, included in an antenna device, and a lower structure of the connection member according to an example.
Figure 4B:
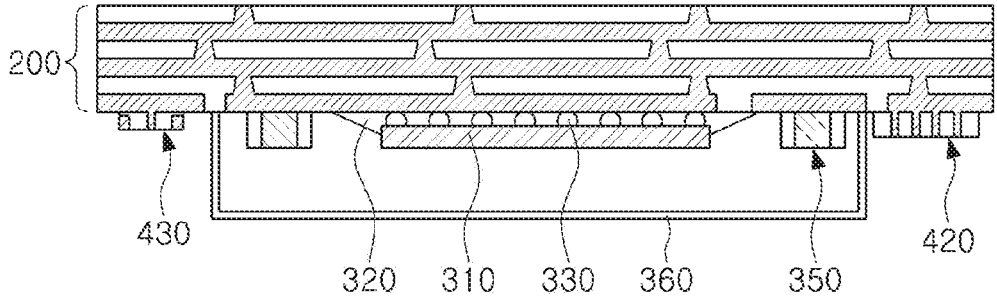

FIGS. 4A and 4B are side views of a connection member on which a ground plane is stacked, included in an antenna device, and a lower structure of the connection member according to examples.

Referring to FIG. 4A, an antenna apparatus may include at least some of a connection member 200, an IC 310, an adhesive member 320, an electrical interconnect structure 330, an encapsulant 340, a passive component 350, and a sub-substrate 410.

The connection member 200 may have a structure in which the plurality of ground planes described in the aforementioned examples may be stacked.

The IC 310 may be the same as the IC described in the aforementioned examples, and may be disposed below the connection member 200. The IC 310 may be connected to a wiring line of the connection member 200 and may transmit an RF signal to and receive an RF signal from the connection member 200. The IC 310 may also be electrically connected to a ground plane and may be provided with a ground. For example, the IC 310 may perform at least some of operations of frequency conversion, amplification, filtering, phase control, and power generation and may generate a converted signal.

The adhesive member 320 may attach the IC 310 to the connection member 200.

The electrical interconnect structure 330 may electrically connect the IC 310 to the connection member 200. For example, the electrical interconnect structure 330 may have a structure such as that of a solder ball, a pin, a land, and a pad. The electrical interconnect structure 330 may have a melting point lower than that of a wiring line and a ground plane of the connection member 200 such that the electrical interconnect structure 330 may electrically connect the IC 310 to the connection member 200 through a required process using the low melting point.

The encapsulant 340 may encapsulate at least a portion of the IC 310, and may improve heat dissipation performance and protection performance against impacts. For example, the encapsulant 340 may be implemented by a photoimageable encapsulant (PIE), an Ajinomoto build-up film (ABF), an epoxy molding compound (EMC), or the like.

The passive component 350 may be disposed on a lower surface of the connection member 200, and may be electrically connected to a wiring line and/or a ground plane of the connection member 200 through the electrical interconnect structure 330.

The sub-substrate 410 may be disposed below the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency of an RF signal (e.g., 24 GHz, 28 GHz, 36 GHz, 39 GHz, 60 GHz) may be higher than a frequency of an IF signal (e.g., 2 GHz, 5 GHz, 10 GHz, or the like).

For example, the sub-substrate 410 may transmit an IF signal or baseband signal to the IC 310 or may receive an IF signal or baseband signal from the IC 310 through a wiring line included in an IC ground plane. As a first ground plane of the connection member 200 is disposed between the IC ground plane and a wiring line, an IF signal or a baseband signal and an RF signal may be electrically isolated from each other in an antenna module.

Referring to FIG. 4B, the antenna apparatus may include at least some of a shielding member 360, a connector 420, and a chip antenna 430.

The shielding member 360 may be disposed below the connection member 200 and may enclose the IC 310 along with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may have an accommodating space having a hexahedral form by being combined with the connection member 200. The shielding member 360 may be implemented by a material having relatively high conductivity such as copper such that the shielding member 360 may have a relatively short skin depth, and the shielding member 360 may be electrically connected to a ground plane of the connection member 200. Accordingly, the shielding member 360 may reduce electromagnetic noise which the IC 310 and the passive component 350 may receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The chip antenna 430 may transmit and/or receive an RF signal in addition to the antenna apparatus. For example, the chip antenna 430 may include a dielectric block having a dielectric constant higher than that of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 5A:
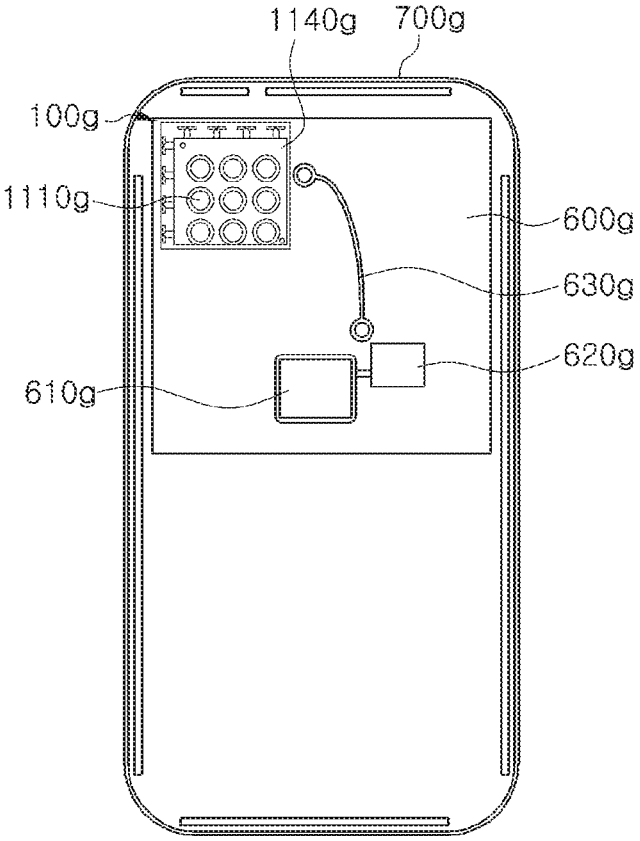
FIGS. 5A and 5B are plan views of arrangement of an antenna apparatus in an electronic device according to an example.
Figure 5B:
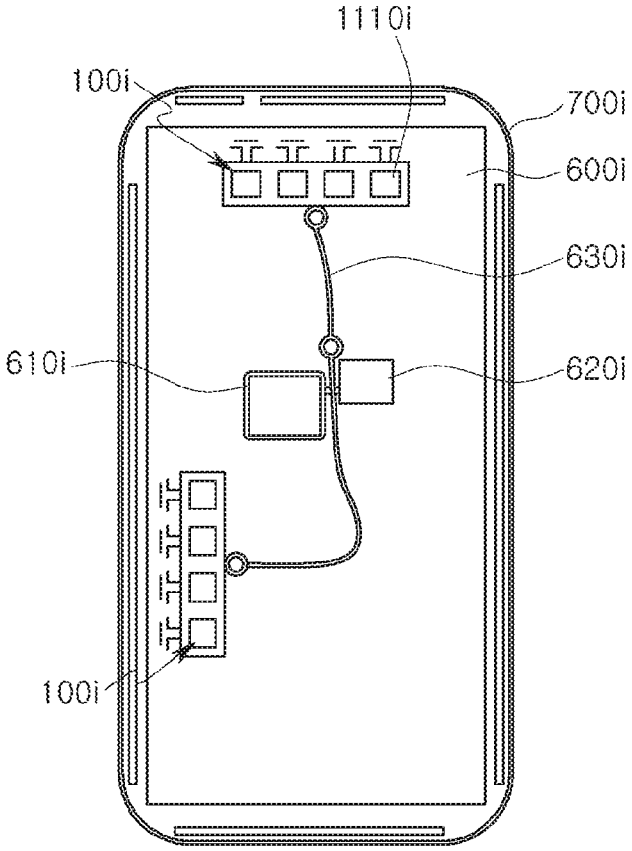

FIGS. 5A and 5B are plan diagrams illustrating an arrangement of an antenna apparatus in an electronic device according to examples.

Referring to FIG. 5A, an antenna apparatus 100*g* including a patch antenna pattern 1110*g* and a dielectric layer 1140*g* may be disposed adjacent to a side surface boundary of an electronic device 700*g* on a set substrate 600*g* of the electronic device 700*g*.

The electronic device 700*g* may be implemented by a smartphone, a personal digital assistant, a digital video camera, a digital still camera, a network system, a computer, a monitor, a tablet PC, a laptop PC, a netbook PC, a television, a video game, a smart watch, an automotive component, or the like, but an example of the electronic device 700*g* is not limited thereto.

A communication module 610*g* and a baseband circuit 620*g* may further be disposed on the set substrate 600*g*. The antenna module may be electrically connected to the communication module 610*g* and/or the baseband circuit 620*g* through a coaxial cable 630*g*.

The communication module 610*g* may include at least some of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna module through a cable.

For example, the base signal may be transferred to an IC through an electrical interconnect structure, a cover via, and a wiring line. The IC may convert the base signal into an RF signal of millimeter wave (mmWave) band.

Referring to FIG. 5B, a plurality of antenna apparatuses 100*i* each including a patch antenna pattern 1110*i* may be disposed adjacent to a center of an edge of a polygonal electronic device 700*i* on a set substrate 600*i* of the electronic device 700*i*, and a communication module 610*i* and a baseband circuit 620*i* may further be disposed on the set substrate 600*i*. The plurality antenna apparatuses and the antenna modules may be electrically connected to the communication module 610*i* and/or baseband circuit 620*i* through a coaxial cable 630*i*.

The pattern, the via, the line, and the plane described in the aforementioned example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The dielectric layer in the example embodiments may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, such as prepreg, a Ajinomoto build-up film (ABF), FR-4, bismaleimide triazine (BT), a photoimagable dielectric (PID) resin, a general copper clad laminate (CCL), glass or a ceramic-based insulating material, or the like.

The RF signal described in the example embodiments may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but not limited thereto.

According to the aforementioned examples, the antenna apparatus may have improved antenna performances (e.g., a gain, a bandwidth, directivity, and the like), and/or may be easily miniaturized.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground plane;

a first patch antenna pattern disposed above and spaced apart from a first surface of the ground plane;

a second patch antenna pattern disposed above and spaced apart from the first surface of the ground plane, and spaced apart from the first patch antenna pattern;

a second feed via configured to provide a second feed path of the second patch antenna pattern through a point of the second patch antenna pattern, and disposed adjacent to an edge of the second patch antenna pattern that is adjacent to the first patch antenna pattern along a first direction;

a first feed via configured to provide a first feed path of the first patch antenna pattern through a point of the first patch antenna pattern, and disposed adjacent to an edge of the first patch antenna pattern that is opposite to the second patch antenna pattern along the first direction;

a first coupling pattern disposed between the first patch antenna pattern and the second patch antenna pattern along the first direction, and spaced apart from the first patch antenna pattern and the second patch antenna pattern along the first direction;

a ground via configured to electrically connect the first coupling pattern to the ground plane; and a second coupling pattern disposed between the second patch antenna pattern and the first coupling pattern along the first direction, spaced apart from the second patch antenna pattern and the first coupling pattern along the first direction, and separated from the ground plane.

2. The antenna apparatus of claim 1, wherein the first feed via includes a plurality of first feed vias, wherein the first coupling pattern includes a plurality of first coupling patterns, and wherein at least two of the plurality of first coupling patterns are spaced apart from each other along a second direction.

3. The antenna apparatus of claim 2, wherein the ground via includes a plurality of ground vias electrically connected to the plurality of first coupling patterns, respectively.

4. The antenna apparatus of claim 2, wherein a length of the second coupling pattern along the second direction is larger than a length of each of the at least two of the plurality of first coupling patterns along the second direction.

5. The antenna apparatus of claim 2, wherein a gap between the at least two of the plurality of first coupling patterns along the second direction is smaller than a gap between the at least two of the plurality of first coupling patterns and the second coupling pattern along the first direction.

6. The antenna apparatus of claim 1, wherein a length of the first patch antenna pattern along a second direction is larger than a length of the first coupling pattern along the second direction and a length of the second coupling pattern along the second direction.

7. The antenna apparatus of claim 1, wherein a width of the second coupling pattern along the first direction is smaller than a width of the first coupling pattern along the first direction.

8. The antenna apparatus of claim 1, wherein a gap between the first coupling pattern and the second coupling pattern along the first direction is smaller than a gap between the first coupling pattern and the first patch antenna pattern along the first direction.

9. The antenna apparatus of claim 8, wherein a gap between the first coupling pattern and the second coupling pattern along the first direction is smaller than a gap between the second coupling pattern and the second patch antenna pattern along the first direction.

10. The antenna apparatus of claim 1, wherein the second patch antenna pattern is spaced apart from the first surface of the ground plane more than the first patch antenna pattern.

11. The antenna apparatus of claim 10, further comprising:

a first upper patch pattern disposed above and spaced apart from a surface of the first patch antenna pattern opposite the ground plane; and a second upper patch pattern disposed above and spaced apart from a surface of the second patch antenna pattern opposite the ground plane, wherein a spacing between the second patch antenna pattern and the second upper patch pattern is smaller than a spacing between the first patch antenna pattern and the first upper patch pattern.

12. The antenna apparatus of claim 1, further comprising:

a first upper patch pattern disposed above and spaced apart from a surface of the first patch antenna pattern opposite the ground plane;

a second upper patch pattern disposed above and spaced apart from a surface of the second patch antenna pattern opposite the ground plane; and an upper coupling pattern disposed above and spaced apart from a surface of the first coupling pattern opposite the ground plane.

13. The antenna apparatus of claim 12, wherein the second coupling pattern does not overlap the upper coupling pattern in a thickness direction of the antenna apparatus.

14. An antenna apparatus, comprising:

a ground plane;

second patch antenna patterns disposed above and spaced apart from a first surface of the ground plane along a thickness direction of the antenna apparatus, and spaced apart from each other along a first direction normal to the thickness direction;

first patch antenna patterns disposed above and spaced apart from the first surface of the ground plane along the thickness direction, spaced apart from each other along the first direction, and disposed between the second patch antenna patterns along the first direction;

second feed vias configured to provide second feed paths of the second patch antenna patterns through respective second points of the second patch antenna patterns disposed adjacent to edges of the second patch antenna patterns that are adjacent to the first patch antenna patterns along the first direction;

first feed vias configured to provide first feed paths of the first patch antenna patterns through respective first points of the first patch antenna patterns disposed adjacent to edges of the first patch antenna patterns opposite the adjacent second patch antenna patterns along the first direction;

first coupling patterns disposed between the first patch antenna patterns and the second patch antenna patterns along the first direction, and spaced apart from the first patch antenna patterns and the second patch antenna patterns along the first direction; and at least one upper patch pattern disposed above and spaced apart from one or more of the first patch antenna patterns and the second patch antenna patterns opposite the ground plane, wherein a space disposed between the first patch antenna patterns and spaced apart from the first surface of the ground plane a same distance as the first patch antenna patterns includes a non-conductive material or air, and wherein the second patch antenna patterns are spaced apart from the first surface of the ground plane more than the first patch antenna patterns.

15. The antenna apparatus of claim 14, wherein the at least one upper patch pattern comprises:

first upper patch patterns disposed above and spaced apart from surfaces of the first patch antenna patterns opposite the ground plane; and second upper patch patterns disposed above and spaced apart from surfaces of the second patch antenna patterns opposite the ground plane, and wherein a spacing between the second patch antenna patterns and the second upper patch patterns is smaller than a spacing between the first patch antenna patterns and the first upper patch patterns.

16. The antenna apparatus of claim 14, further comprising:

upper coupling patterns disposed above and spaced apart from surfaces of the first coupling patterns opposite the ground plane, wherein the at least one upper patch pattern comprises:

first upper patch patterns disposed above and spaced apart from surfaces of the first patch antenna patterns opposite the ground plane;

second upper patch patterns disposed above and spaced apart from surfaces of the second patch antenna patterns opposite the ground plane.

17. The antenna apparatus of claim 16, further comprising:

a third upper patch pattern disposed between the first upper patch patterns along the first direction.

18. The antenna apparatus of claim 14, further comprising:

ground vias electrically connecting the first coupling patterns to the ground plane.

19. The antenna apparatus of claim 14, wherein the at least one upper patch pattern comprises:

first upper patch patterns disposed above and spaced apart from surfaces of the first patch antenna patterns opposite the ground plane; and second upper patch patterns disposed above and spaced apart from surfaces of the second patch antenna patterns opposite the ground plane.

20. An antenna apparatus, comprising:

a ground plane;

a first patch antenna pattern spaced apart from a first surface of the ground plane by a first distance along a first direction;

a second patch antenna pattern spaced apart from the first surface of the ground plane by a second distance along the first direction, and spaced apart from the first patch antenna pattern along a second direction normal to the first direction;

a coupling pattern spaced apart from the first surface of the ground plane by a third distance along the first direction, and disposed between the first patch antenna pattern and the second patch antenna pattern along the second direction;

a first feed via disposed between the ground pattern and the first patch antenna pattern, and disposed closer to an edge of the first patch antenna pattern that is farther from the first coupling pattern than a center of the first patch antenna pattern;

a second feed via disposed between the ground pattern and the second patch antenna pattern, and disposed closer to an edge of the second patch antenna pattern that is closer to the first coupling pattern than the center of the first patch antenna pattern;

a first upper patch pattern disposed above and spaced apart from a surface of the first patch antenna pattern opposite the ground plane; and a second upper patch pattern disposed above and spaced apart from a surface of the second patch antenna pattern opposite the ground plane.

21. The antenna apparatus of claim 20, wherein the first distance is equal to the second distance.

22. The antenna apparatus of claim 21, wherein the first distance is equal to the third distance.

23. The antenna apparatus of claim 20, wherein the first distance is not equal to the second distance.

24. The antenna apparatus of claim 23, wherein the first distance is equal to the third distance.

* * * * *